US005194689A

United States Patent [19]

Cummins

[11] Patent Number: 5,194,689

[45] Date of Patent: Mar. 16, 1993

[54] EARTH EXCAVATION USING BLAST CASTING AND EXCAVATING APPARATUS

[75] Inventor: Monica S. Cummins, Gillette, Wyo.

[73] Assignee: Atlantic Richfield Company, Los Angeles, Calif.

[21] Appl. No.: 797,603

[22] Filed: Nov. 25, 1991

[51] Int. Cl.[5] ..... F42D 3/00; E21C 41/28

[52] U.S. Cl. ..... 102/302; 299/13

[58] Field of Search ..... 102/301, 302; 299/13

[56] References Cited

U.S. PATENT DOCUMENTS

| | | | |
|---|---|---|---|
| 3,775,984 | 12/1973 | Livingston | 102/23 X |
| 3,792,906 | 2/1974 | Kuck | 102/23 X |
| 4,223,734 | 9/1980 | Lekas | 102/23 X |
| 4,244,624 | 1/1981 | Nitzberg | 102/23 X |
| 4,262,965 | 4/1981 | Ricketts | 102/23 X |

*Primary Examiner*—Peter A. Nelson

*Attorney, Agent, or Firm*—Michael E. Martin

[57] ABSTRACT

Coal and other mineral seams are uncovered to a desired width or "cut" by blast casting a portion of the overburden material above the seam into an adjacent pit portion followed by moving a dragline or other excavating apparatus onto a bench surface below the bench height of the unblasted overburden and building an extended bench portion with overburden material from above the seam to be uncovered. The excavating apparatus then moves onto the extended bench and removes overburden material from directly above the seam to a final spoil pile. The excavating apparatus may be returned to the start of the next cut by a return road, by building a return road along the spoil pile or by reversing its direction over the extended bench to uncover the seam.

13 Claims, 4 Drawing Sheets

EARTH EXCAVATION USING BLAST CASTING AND EXCAVATING APPARATUS

BACKGROUND OF THE INVENTION

1. Field of the Invention

The present invention pertains to a method for removing overburden material or performing similar earth excavation using blast casting of the overburden material and further removal with an excavator such as a dragline, both in such a way as to reduce the excavating effort to expose a coal or other mineral seam, for example.

2. Background

In large-scale surface mining of coal and other minerals, the removal of overburden earth material is usually the most time-consuming and costly part of the mining process. Other earth excavation operations for construction purposes also, in many instances, consume a major portion of the capital employed in the overall effort. In surface mining, for example, the volume of material mined and the competitive pricing of many minerals, such as coal, is of such magnitude that savings in excavating time and wear and tear on excavating equipment more than offsets any costs due to the requirements to drill blast holes and then blast cast at least a portion of the overburden material in the excavating effort. In this regard the present invention has been developed with a view to utilizing blast casting techniques together with a unique overburden removal process utilizing an excavating apparatus such as a dragline or the like. Another improved method for excavating material in surface mining operations is described and claimed in a patent application entitled "Method for Surface Mining with Dragline and Blast Casting", filed of even date herewith in the name of Steven M. Svatek and assigned to the assignee of the present invention.

SUMMARY OF THE INVENTION

The present invention provides a unique method of earth excavation, such as the removal of overburden from a coal or other mineral pit, particularly a pit of substantial width.

The present invention also provides a unique method of uncovering a mineral seam by removal of the overburden material using a combination of blast casting and an excavating apparatus such as a dragline or the like.

In accordance with one important aspect of the present invention, a unique earth excavation method is provided which is particularly suitable for surface mining to uncover a mineral seam of substantial width by blast casting a portion of the overburden from over the mineral seam into an adjacent pit area which has already been mined, followed by a single pass overburden removal process using a dragline or similar excavating machine. After blast casting a portion of the overburden into an area adjacent to the part of the mineral seam to be uncovered the excavating apparatus is deployed onto the blast cast overburden material remaining above the seam and begins removal of the overburden material to build an extended bench or support area onto which the excavating apparatus then moves prior to completing the mineral seam uncovering process.

Further in accordance with the present invention a method is provided wherein the excavating apparatus builds its own support portion by excavating overburden material which has been loosened and partially moved by a blast casting process. The excavating apparatus progressively builds its own extended support or bench portion with blast cast material and with material excavated to uncover the mineral seam or the final area to be cleared of overburden material. Moreover, the mineral seam or area to be cleared may be uncovered in a single pass of the excavating apparatus along the length of the excavation.

In accordance with another important aspect of the present invention, methods are provided for completing a cycle of uncovering a first portion of the mineral seam and returning the excavating apparatus to a starting point for uncovering a second portion or "cut" of the mineral seam. In one of these methods the excavating apparatus, which may be of substantial size such as a large dragline, is moved from a higher elevation of the overburden surface to the level of the blast cast overburden material and then returned to the higher elevation on prepared earth ramps. The present invention also provides alternate methods of making multiple excavations or "cuts" of a mineral seam using the basic excavation method and whereby the excavating apparatus is moved more efficiently and productively from one end of a cut to the opposite end to begin a new cut.

The above-noted advantages and superior features of the method of the present invention, together with other important aspects thereof will be further appreciated by those skilled in the art upon reading the detailed description which follows in conjunction with the drawings.

DESCRIPTION OF A PREFERRED EMBODIMENT

Figure 1:
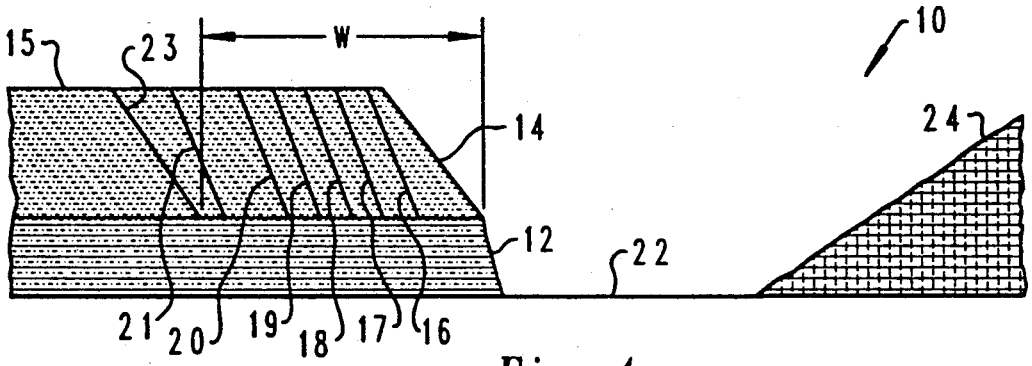
FIGS. 1 through 5 represent schematic diagrams showing the steps in the method of the present invention taken as a cross-section of a mineral seam to be uncovered and generally along the line 2—2 of FIG. 6.

In the description which follows, like elements are marked with the same reference numerals throughout the specification and drawing, respectively. The drawing figures are not necessarily to scale and the method of the present invention is depicted in somewhat schematic form in the interest of clarity and conciseness. Drawing FIGS. 1 through 5 show a cross-section of a mineral seam such as a coal seam uncovered in open-pit mining. The "length" of the seam and the pit run normal to the plane of the paper on which the drawing figures are depicted as indicated by the perspective view of FIG. 6. In other words, the excavating machine described below also moves progressively in a direction normal to the plane of the paper, viewing FIGS. 1 through 5 as it progressively transfers material to the lateral positions depicted in drawing FIGS. 1 through 5.

Figure 5:
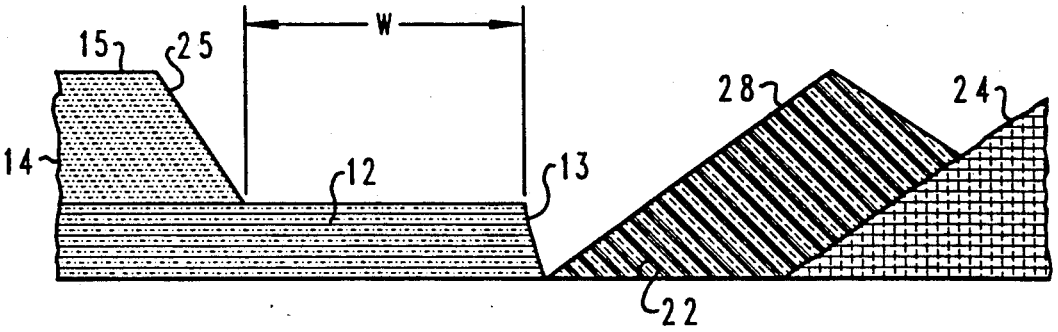
Figure 6:
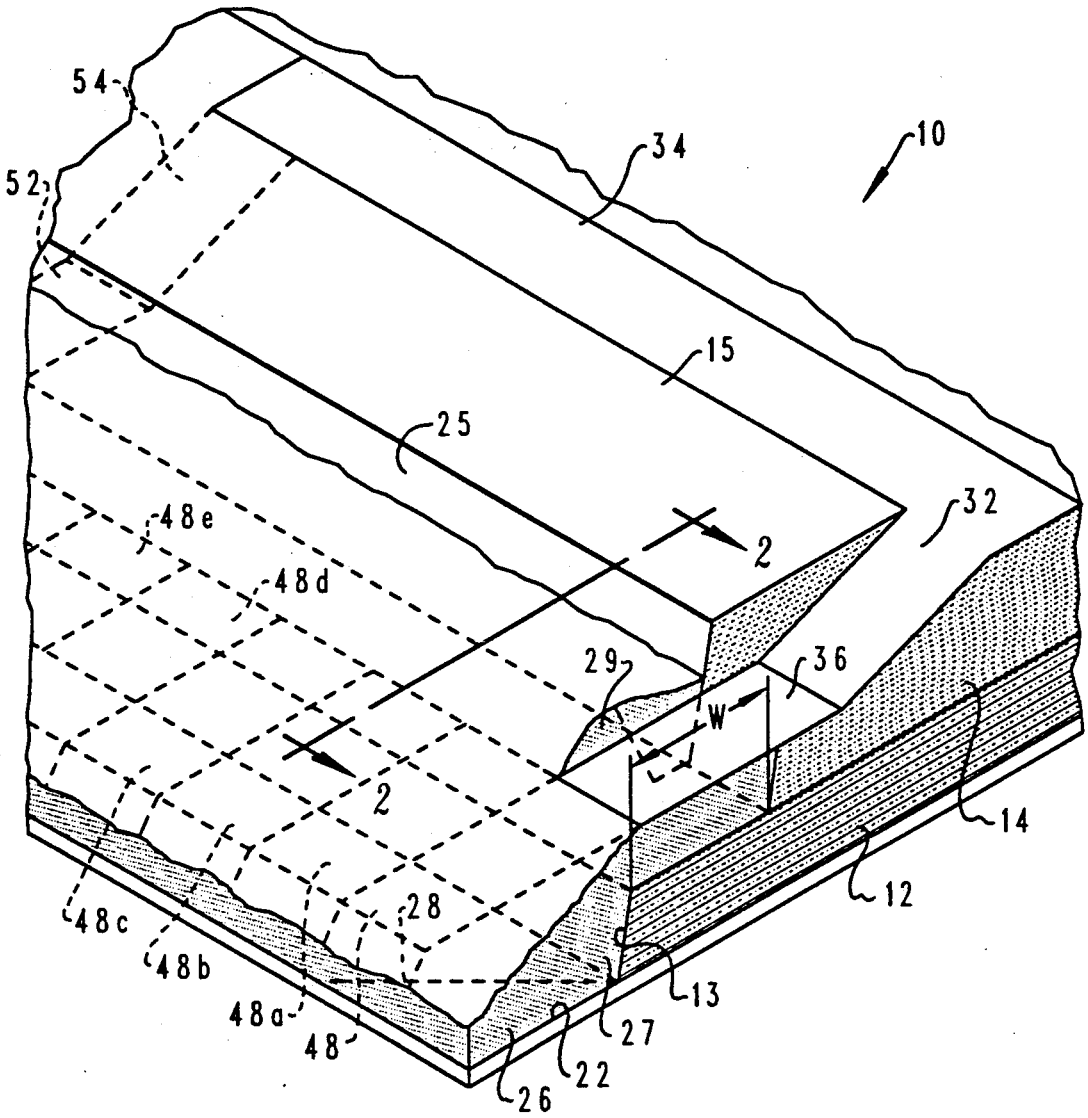
FIG. 6 is a perspective view showing a mineral seam and the overburden material after the blast casting process but before excavation has begun.

Referring to FIGS. 1 and 6, there is illustrated, in somewhat schematic form, a portion of an open-pit coal mine, generally designated by the numeral 10. The mine 10 is being operated to remove material from a coal seam 12 of relatively uniform thickness and having a vertical extent relative to overburden earth material 14 as indicated. The layer of overburden earth material 14 is disposed over the coal seam 12 to an elevation delimited by surface 15 and a portion of the overburden material has been prepared for blast casting by the drilling of a preselected pattern of blast holes designated by the numerals 16, 17, 18, 19, 20, 21 and 23, as shown in FIG. 1. The mine 10 includes a pit portion 22 forming an excavation between the coal seam 12 and a spoil pile 24, which pit portion has been formed by previous mining to remove coal from the mine 10. The mine 10 is being worked to at least remove overburden by a dragline-type excavating apparatus, not shown in FIG. 1. The width of the coal seam 12 to be uncovered of overburden material in accordance with the present invention is significant, may vary according to the type of equipment used and may be on the order of 150 feet to 250 feet, for example. This width is indicated by the dimension "W" in FIGS. 1 and 5. The length of the excavation or portion of the coal seam 12 to be uncovered or the so-called "cut" to be taken may be limited only by the geology of the seam, the property boundary of the mine 10, or other predetermined parameters.

Figure 2:
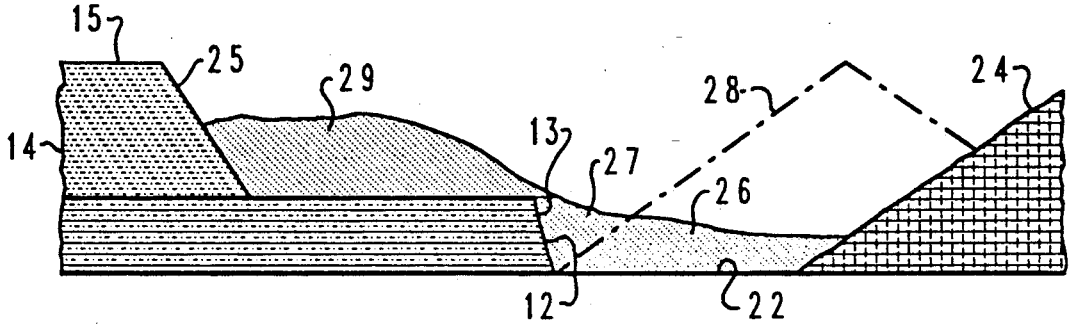

Referring to FIGS. 2 and 6, there is illustrated the condition wherein the overburden material 14 has been blast cast after loading suitable rows of blast holes 16, 17, 18, 19, 20, 21 and a pre-split row 23, FIG. 1, with suitable explosives and detonating those explosives to fragment and cast at least a portion of the overburden material into the pit 22, which portion of the overburden material is indicated by the numeral 26. Cleaving some of the overburden away from the main body of material 14 leaves a "highwall" 25. At least a major part of the overburden material 26 has thus been cast to its final resting place and does not require movement by any excavating apparatus. In fact, only a small portion of the overburden material 26 cast into the pit 22 will require further excavation and that material is bound by the face 13 of the coal seam 12 and the boundary of a final spoil pile indicated by the numeral 28 in FIG. 2. That relatively small portion of overburden material is indicated by the numeral 27 in FIG. 2. The remaining uncast portion 29 of the overburden material has nevertheless been loosened and is ready for excavation by conventional excavating apparatus such as the aforementioned dragline.

Blast casting techniques, in general, are known in the art of surface mining, are believed to be within the purview of one skilled in the art and therefore not requiring further discussion herein. Blast casting is discussed in *Coal Mining*, March, 1987, pages 38–40; July, 1987, pages 30–32; August, 1987, pages 32–34; September, 1987, pages 36–38; and in Coal, June, 1988, pages 48–50; November, 1988, pages 82–84; and June, 1989, pages 41–44.

Referring now primarily to FIG. 6, the mine 10 is further prepared for removal of overburden material to uncover the coal seam 12 by preparing an earth ramp 32 leading from a return road 34 to a bench portion 36 which extends out into the blast cast overburden material 29. The ramp 32 and the bench 36 may be constructed using conventional equipment, not shown, including the dragline mentioned above and conventional earth-moving equipment such as crawler tractors with bulldozing blades thereon, also not shown.

Figure 3:
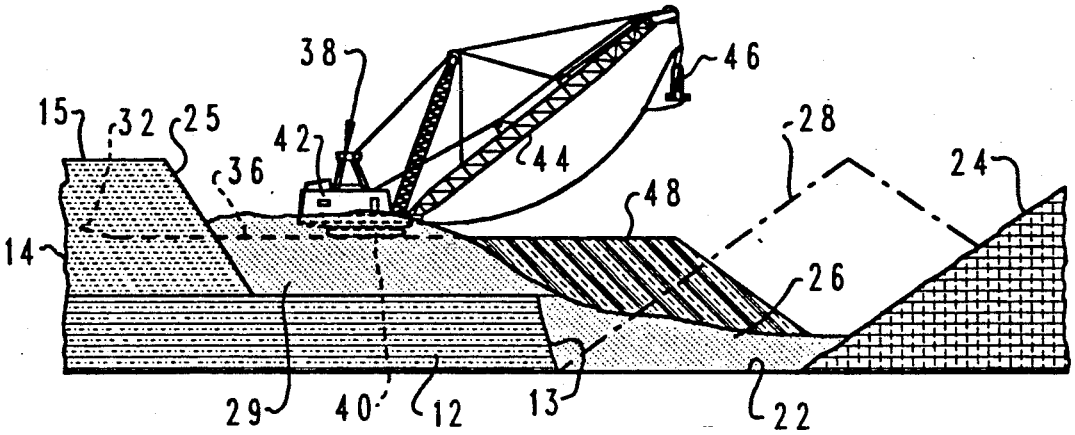
Figure 4:
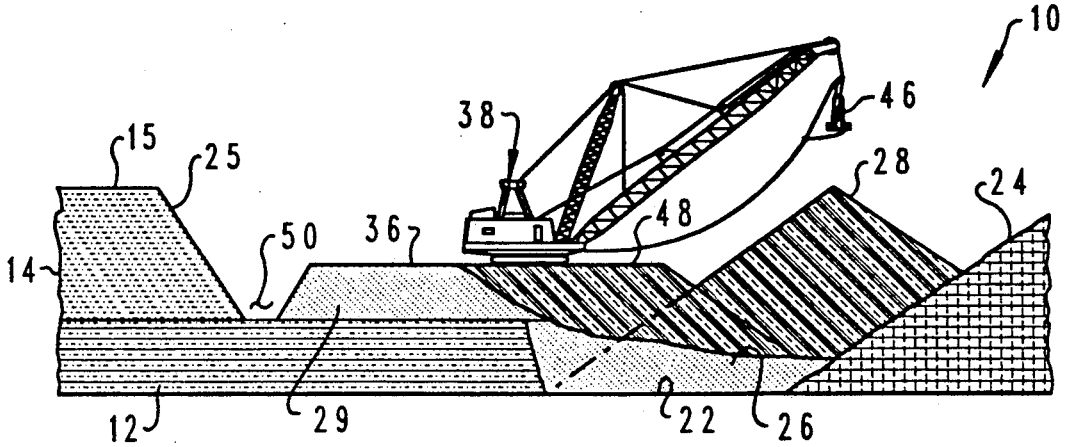

Once overburden material has been excavated to form the ramp 32 and the bench 36, an excavating apparatus such as a dragline 38 is moved onto the bench 36 to the position generally as indicated in FIG. 3. The dragline 38 is of conventional construction including an undercarriage 40 which may be of the crawler or "walking" type and supporting a house 42 for pivotal movement thereon. A conventional boom 44 supports an excavating bucket 46 via suitable hoist and drag ropes. In FIG. 3, the excavating apparatus 38 has begun to move overburden material to build an extension 48 of the bench 36 using overburden material 29 which is removed to form a further longitudinal extent of the bench 36; such longitudinal extent being generally parallel to the road 34 in FIG. 6. After the bench extension 48 is formed of at least sufficient width to move the dragline 38 onto the bench extension, the dragline then assumes the position generally as indicated in FIG. 4 and begins removing overburden material 29 from above the coal seam 12, as indicated by the so-called key cut 50 already formed in FIG. 4. The dragline 38 continues to excavate overburden material 29 to uncover the coal seam 12 to the width W while building the extended bench portion 48 progressively to the left, viewing FIG. 6, or out of the paper, viewing FIG. 5, to provide a support surface for the dragline so that it can continue to uncover the overburden material 29 and place it on the spoil pile 28, which is progressively formed as indicated in FIG. 4.

As the dragline 38 moves progressively to the left, viewing FIG. 6, to build the extended bench 48 ahead of itself, it also works behind to remove that portion of the extended bench 48 which is no longer useful to it and deposits that material on the spoil pile 28, also. For example, the dragline 38, after moving onto the extended bench 48 begins to longitudinally extend the bench 48 by moving overburden material 29 to form bench portion **48*a* and depositing any excess material from over the seam 12 to the spoil pile 28. The dragline 38 then moves onto bench portion 48*a* and continues to move overburden material 29 from above the coal seam 12 and from the bench portion 48 to build bench portion 48*c* and to deposit excess material to the spoil pile 28. As the dragline 38 progressively builds extended bench portions 48*c*, 48*d* and so on, it uncovers the coal seam 12 to the final configuration shown in FIG. 5. Thus, in a "single pass" along the coal seam 12 the seam is uncovered to the width W and is ready to be mined by conventional methods, which are not a part of the present invention. The final configuration of the seam 12 is indicated in FIG. 5 wherein it has been uncovered completely to the width W and all of the overburden material has been placed in the spoil pile 28**.

As shown in FIG. 6, when the dragline has traversed the desired length of the coal seam 12, it may traverse back to the return road 34 by way of a bench portion 52 and a ramp 54 formed in accordance with the same practice as used to form the ramp 32 and the bench portion 36. Once the coal has been removed from the seam 12 to the width W, a new pit portion is formed and additional overburden material 14 may be removed in the same manner as described hereinabove to take additional "cuts" of the overburden material and uncover a second portion of the coal seam 12 also, preferably, to a width W.

Figure 7:
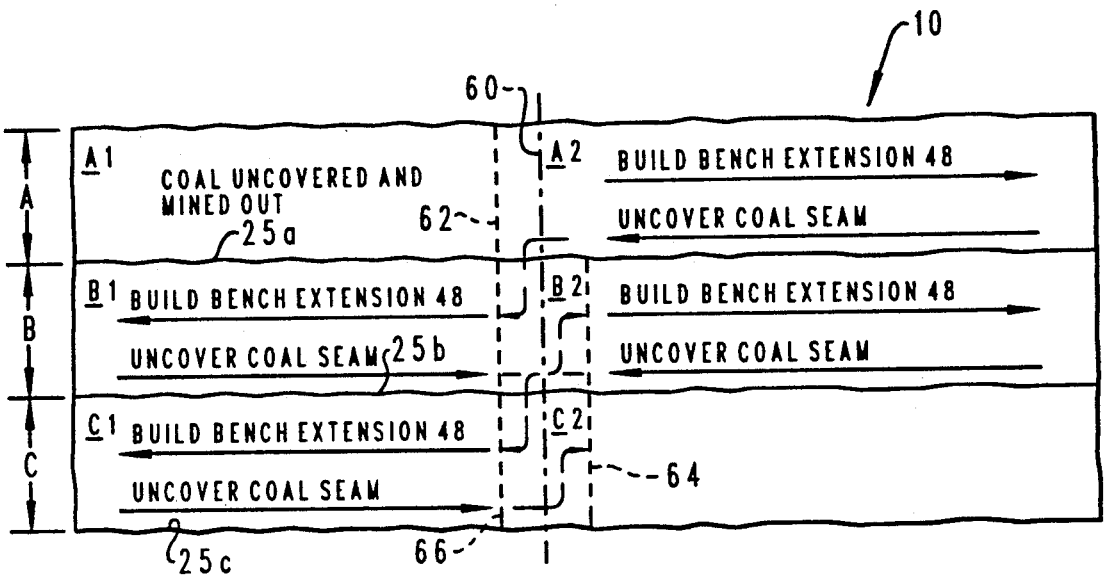
FIGS. 7 and 8 are diagrams showing modifications to the method for returning the excavating apparatus to start a new cut.

Referring now to FIG. 7, a first alternate method is illustrated for returning the dragline 38 to a point to uncover additional coal without having to undergo idle time to return to a starting point. FIG. 7 is a diagram in plan view of a mineral seam to be uncovered in discrete segments of cuts A, B and C, as indicated by the reference numerals A1, A2, B1, B2, C1 and C2, respectively. Depending on the volume of coal to be mined out in each segment A1, A2 and so on, a so-called split-line 60 is designated to divide the segments A1 and A2 into appropriate portions based on the volume of coal in the seam or cut A.

For the sake of discussion, assume that the segment A1 of the cut A has been uncovered and already mined out so that it has the configuration of the pit portion 22 illustrated in FIG. 1. The excavating apparatus or dragline 38, not shown in FIG. 7, traverses the length of the segment A2 to build the bench extension 48 after, of course, blast casting overburden away from highwall 25*a*. After building the bench extension 48 for segment A2, the direction of movement of the excavating apparatus is reversed and it traverses back toward the split-line 60 to uncover the mineral seam in the segment A2. When the dragline reaches the split-line 60 it builds a sufficient pad or bench extension portion 62 to permit traversal of the dragline onto the segment B1, which has been previously blasted to cast overburden toward the mined out pit portion of segment A1. The dragline then builds a bench extension 48 as it traverses from the split-line 60 to the opposite end of segment B1, reverses its direction and uncovers coal back toward the split-line 60. In the meantime, of course, coal is removed from the segment A2 and segment B2 is prepared for removal of overburden by blast casting operations to cast a portion of the overburden into the pit of segment A2.

As the dragline approaches the split-line 60 from segment B1 it builds a pad 64 and positions itself to build yet another bench extension 48 along the segment B2. As the dragline reaches the end of segment B2, to the far right viewing FIG. 7, it reverses its direction and uncovers the mineral (coal) seam by moving back toward the split-line 60. A pad extension 66 is then built with overburden material and, after blast casting the overburden in segment C1, the dragline moves onto the pad 66 and builds yet another segment of bench extension 48 in the manner described in conjunction with FIGS. 2 and 3 along the segment C1. The cycles just described may, of course, be repeated as often as needed to uncover a coal seam having a predetermined width.

Figure 8:
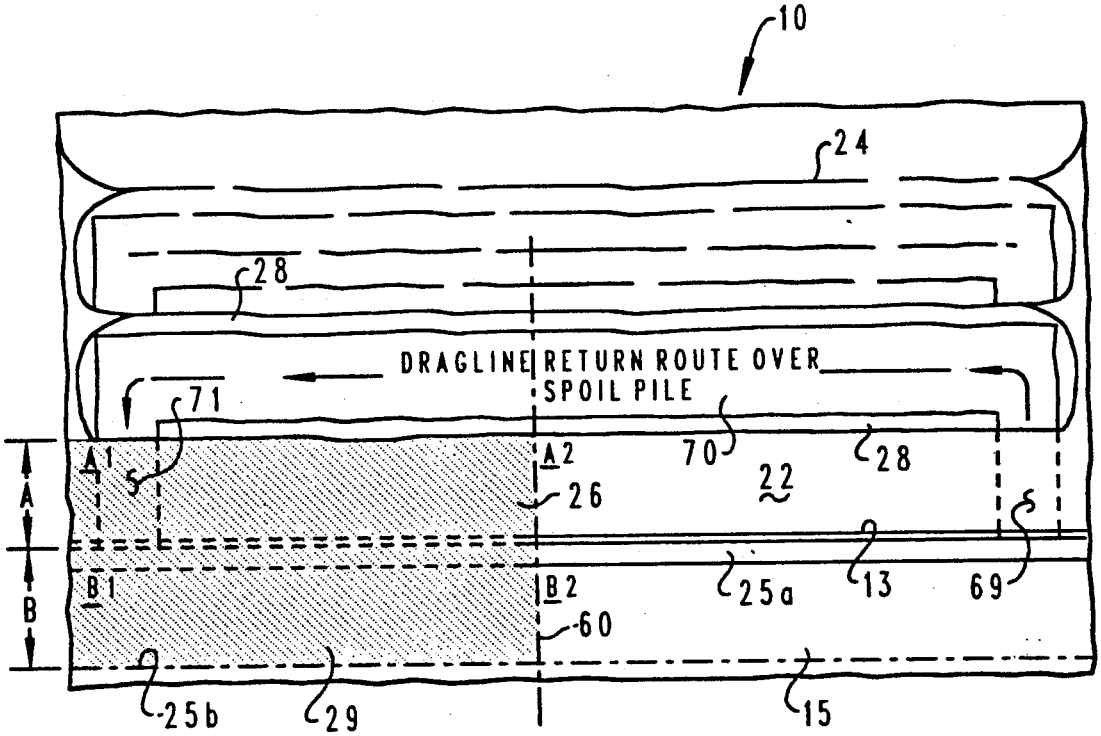

Referring now to FIG. 8, which is also a diagrammatic plan view of the mine 10, a second alternate method of carrying out a complete mining cycle is illustrated. In FIG. 8, it is assumed that coal has been mined out of the mine 10 along all of cut A. In FIG. 8 overburden has already been blast cast in segment B1 of cut B to the left of the split line 60. As the dragline 38, not shown in FIG. 8, reaches the end of cut A, that is to the right side of the diagram of FIG. 8, it is operated to build a pad 69 across to the spoil pile 28 and forms a flat portion of the spoil pile by depositing spoil into a valley formed between the spoil pile 28 and the previous spoil pile 24. In other words the "peak" of the spoil pile 28 is cut down or leveled to form a roadway 70 and the material removed from the peak of the spoil pile 28 is used to fill the valley formed between the spoil piles 28 and 24. A brief reference to FIG. 4 will give one to realize that the pad 69 is formed at least in part by the bench extension 48 at the end of cut A. In this way, at least a part of the reclamation process of levelling the spoil piles is carried out at the same time as the dragline forms its own return route by building roadway 70 along the length of the spoil pile 28.

As the dragline reaches the far left side of the diagram of FIG. 8, it builds a second pad 71 across to the already blast cast overburden 26, 29. The dragline then proceeds to build a bench extension 48 and uncover coal back to a new highwall 25*b* the dragline moves toward the split-line 60 as it uncovers coal and forms a new spoil pile. During this process, previously unblasted overburden between the line 60 and the far right side of the diagram of FIG. 8 is prepared for blast casting and the dragline then continues to carry out the method of uncovering a mineral seam generally as described in conjunction with FIGS. 1 through 6. Accordingly, in the method described above in conjunction with FIG. 8, the excavating apparatus, such as the dragline 38, does not have to "deadhead" from the end of a cut back to the beginning of the next cut but actually carries out a portion of the spoil reclamation process by flattening the peak of a spoil pile 28 as it builds its own return road from one end of a cut to the opposite end of the next cut in the mineral seam.

Although preferred embodiments of the present invention have been described in detail herein, those skilled in the art will recognize that various substitutions and modifications may be made to the methods described without departing from the scope and spirit of the appended claims.

What is claimed is:

1. A method for removing overburden from a mineral seam in the earth comprising the steps of:

determining a portion of said seam to a width to be uncovered;

placing explosive charges in a portion of overburden above said portion of said seam and blast casting overburden above said portion of said seam to a place adjacent to said portion of said seam while leaving a key portion of overburden resting on said portion of said seam;

providing an excavating apparatus;

excavating overburden from above said portion of said seam and building an extended bench portion of said overburden generally above said place adjacent to said portion of said seam to form a support for said excavating apparatus;

moving said excavating apparatus onto said extended bench portion; and excavating said overburden including said key portion of overburden to uncover said portion of said seam.

2. The method set forth in claim 1 wherein:

the step of excavating said key portion of said overburden includes placing at least some of said key portion of said overburden adjacent to said extended bench portion to form an additional extended bench portion.

3. The method set forth in claim 1 wherein:

excavating at least some of said extended bench portion to form a permanent spoil pile adjacent to said portion of said seam.

4. The method set forth in claim 3 including the steps of:

moving said excavating apparatus onto said spoil pile at one end of said portion of said seam;

excavating a part of said spoil pile to form a return road for said excavating apparatus to the opposite end of said portion of said seam.

5. The method set forth in claim 4 including the steps of:

casting overburden over an area defined at least in part by said portion of said seam; and forming an extended bench portion between said spoil pile and a second portion of said seam.

6. The method set forth in claim 1 including the steps of:

providing said excavating apparatus comprising a dragline.

7. The method set forth in claim 1 including the step of:

providing ramp means from a bench height determined by the elevation of said overburden prior to blast casting to an elevation below said bench height and generally coincident with the elevation of said extended bench portion for moving said excavating apparatus to said extended bench portion.

8. The method set forth in claim 7 including the step of:

providing ramp means from an elevation of said extended bench portion to the elevation of said bench height for returning said excavating apparatus back to the elevation of said overburden prior to blast casting.

9. A method for removing overburden from a mineral seam in the earth comprising the steps of:

determining a portion of said seam to a width to be uncovered;

placing explosive charges in a portion of overburden above said portion of said seam and blast casting overburden above said portion of said seam to a place adjacent to said portion of said seam while leaving a key portion of overburden resting on said portion of said seam at an elevation generally lower than the height of unblasted overburden;

providing an excavating apparatus;

excavating overburden from above said portion of said seam and building an extended bench portion of said overburden generally above said place adjacent to said portion of said seam to form a support for said excavating apparatus;

moving said excavating apparatus onto said extended bench portion;

excavating said key portion of said overburden to uncover said portion of said seam and to place at least some of said key portion of said overburden material adjacent to said extended bench portion to form an additional extended bench portion; and excavating at least some of said extended bench portion of overburden material to form a permanent spoil pile adjacent to said portion of said seam and to uncover said portion of said seam.

10. A method for excavating earth material to form an elongated excavation of predetermined width in the earth comprising the steps of:

determining the width of said excavation to be formed;

placing explosive charges in a portion of overburden above said excavation and blast casting overburden above said excavation to a place adjacent to said excavation while leaving a key portion of overburden resting on said excavation at an elevation generally lower than the height of unblasted overburden;

providing an excavating apparatus;

excavating overburden from above said excavation and building an extended bench portion of said overburden generally above said place adjacent to said excavation to form a support for said excavating apparatus;

moving said excavating apparatus onto said extended bench portion;

excavating said excavation to place at least some of said key portion of said overburden adjacent to said extended bench portion to form an additional extended bench portion; and excavating at least some of said extended bench portion to form a permanent spoil pile adjacent to said excavation.

11. A method for surface mining a mineral seam in the earth comprising the steps of:

determining plural generally parallel and adjacent portions of said seam to be uncovered to predetermined widths;

determining a split-line between opposite ends of said respective portions of said seam to form at least first and second segments of each of said portions of said seam, respectively;

removing overburden and mining mineral from a first segment of a first portion of said seam;

blast casting overburden material from a second segment of said first portion of said seam;

providing an excavating apparatus;

(a) excavating overburden above said seam along said second segment of said first portion of said seam from said split-line to form an extended bench portion of said overburden along said second segment of said first portion of said seam;

(b) returning said excavating apparatus along said second segment of said first portion of said seam and excavating overburden from above said second segment of said first portion of said seam;

(c) traversing said excavating apparatus onto overburden above a first segment of a second portion of said seam and excavating overburden above said first segment of said second portion to form an extended bench along said first segment of said second portion of said seam from said split-line to an end of said second portion of said seam;

(d) returning said excavating apparatus in a direction opposite to that which builds an extended bench portion over said first segment of said second portion of said seam and excavating overburden to uncover said seam along said first segment of said second portion of said seam.

12. The method set forth in claim 11 including the step of:

forming a support pad of overburden for traversing said apparatus between said segments, respectively.

13. The method set forth in claim 11 including the steps of:

repeating steps (a) through (d) to remove overburden from all segments of said portions of said seam, respectively.

v

* * * * *